US005638796A

United States Patent [19]

Adams, III et al.

[11] Patent Number: 5,638,796

[45] Date of Patent: Jun. 17, 1997

[54] ELECTRIC SUPERCHARGER

[76] Inventors: Herbert L. Adams, III, 23865 Fairfield Pl., Carmel, Calif. 93923; Harry V. Quackenboss, 13208 Peacock Ct., Cupertino, Calif. 95014

[21] Appl. No.: 253,844

[22] Filed: Jun. 3, 1994

[51] Int. Cl.[6] ..... F02B 39/10; F04B 17/03

[52] U.S. Cl. ..... 123/565; 417/423.7; 417/423.13

[58] Field of Search ..... 123/565; 417/407, 417/423.1, 423.11, 423.12, 423.13, 415, 423.7; 184/11.1, 11.2

[56] References Cited

U.S. PATENT DOCUMENTS

| | | | |
|---|---|---|---|
| 1,723,661 | 8/1929 | Schellens | 417/407 |
| 1,840,253 | 1/1932 | Richardson | 123/565 |
| 2,646,210 | 7/1953 | Kohlmann et al. | 417/407 |
| 3,841,791 | 10/1974 | Doolin | 417/423.12 |
| 4,248,050 | 2/1981 | Durenec | 417/415 |
| 5,217,353 | 6/1993 | Filippis | 417/423.7 |
| 5,340,273 | 8/1994 | Rockwood | 417/423.11 |

FOREIGN PATENT DOCUMENTS

| | | | |
|---|---|---|---|
| 3229458 | 2/1984 | Germany | 417/423.7 |
| 346111 | 6/1960 | Switzerland | 417/423.12 |

*Primary Examiner*—Michael Koczo

*Attorney, Agent, or Firm*—Fliesler, Dubb, Meyer & Lovejoy

[57] ABSTRACT

An electric supercharger is described comprising a centrifugal blower for compressing air. The blower is mounted on one end of a shaft. A first bearing is provided for supporting the blower on said one end of said shaft in a cantilever fashion. The rotor of an electric motor is mounted on the opposite end of said shaft. A second bearing is provided for supporting the rotor on said opposite end of the shaft in a cantilever fashion. A lubricating fluid container is located between the first and the second bearings for containing a quantity of lubricating fluid. A slinger is also mounted on the shaft, which passes through the lubricating fluid container, for slinging the lubricating fluid against the first and second bearings. The motor, which is a brushless d-c motor, is designed to provide in response to a 50 to 100 volt applied potential, approximately 10 horse power at approximately 60,000 rpm's.

14 Claims, 2 Drawing Sheets

ELECTRIC SUPERCHARGER

BACKGROUND OF THE INVENTION

1. Field of the Invention

The present invention relates to apparatus for supercharging internal combustion engines in general and in particular to a direct drive electric supercharger suitable for use in supercharging internal combustion engines used in motor vehicles.

2. Description of the Related Art

A supercharger is used for increasing the output power of an internal combustion engine by increasing the supply of air or combustible mixture to the cylinders beyond that normally pumped in by the pistons at the prevailing atmospheric pressure.

Heretofore, the compressor or blower in an engine supercharger has generally been driven by exhaust gases or by being mechanically coupled in a suitable manner to the crankshaft of the engine.

Among the disadvantages of a supercharger driven by exhaust gases is the need for extra exhaust plumbing to route the exhaust gases to the supercharger and the need to accommodate the high temperatures generally associated with the exhaust gases in a relatively confined engine compartment.

Among the disadvantages of a supercharger mechanically driven by the engine is that it tends to be relatively bulky, mechanically complex and heavy. Additionally, its positioning in the engine compartment is necessarily limited to certain locations.

SUMMARY OF THE INVENTION

In view of the foregoing, a principal object of the present invention is a direct drive electric supercharger which has a number of distinct advantages in comparison to prior known exhaust gas, electrical and engine driven superchargers.

Among the advantages of an electric supercharger according to the present invention is flexible boost control. The use of an electric motor allows for greater flexibility in controlling the blower boost level. Partial throttle boost and limited boost output can be programmed as desired.

Another advantage of an electric supercharger according to the present invention is the quickness of response. Full boost can be reached in about 1.0 second.

Another advantage of an electric supercharger according to the present invention is lower underhood temperatures. Since there is no need for extra exhaust plumbing the underhood temperatures are much lower than with a conventional turbocharger and, since the blower efficiency is higher than with a roots blower, there is less need for an intercooler.

Another advantage of an electric supercharger according to the present invention is system simplicity. All that is required to connect an electric supercharger according to the present invention are wires and low temperature hoses.

Other advantages of an electric supercharger according to the present invention are its compact size and the freedom to position its components which it provides. Because wires and low temperature hoses are used to connect an electric supercharger according to the present invention to an engine, there is more freedom to position the underhood components than in a system using a conventional exhaust gas or engine driven supercharger.

Still another advantage of an electric supercharger according to the present invention is its low system cost. Because it is a simple system that is easy to connect, the total system cost is relatively low as compared to other supercharger systems.

BRIEF DESCRIPTION OF THE DRAWINGS

The above and other objects, features and advantages of the present invention will become apparent from the following detailed description of the accompanying drawings, in which.

DESCRIPTION OF THE PREFERRED EMBODIMENTS

Figure 1:
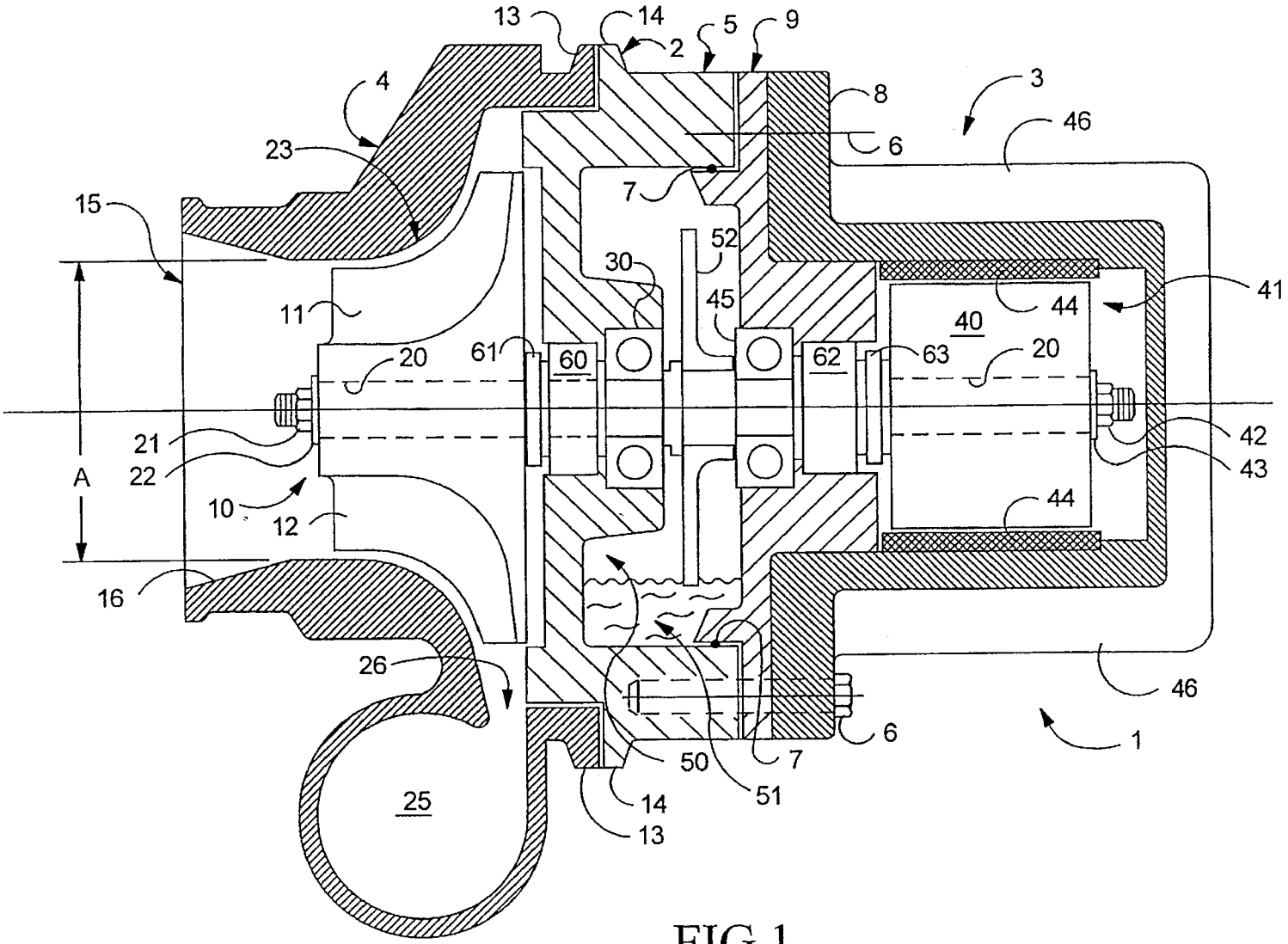
FIG. 1 is a cross-sectional view taken along a plane through the center of an electric supercharger according to an embodiment of the present invention.

Referring to FIG. 1, there is provided an embodiment of an electrical supercharger according to the present invention designated generally as 1. In the supercharger 1 there is provided a first housing assembly designated generally as 2 and a second housing assembly designated generally as 3. The housing assembly 2 comprises a first housing section 4 and a second housing section 5. The housing assembly 3 comprises a first housing section 8 and a second housing section 9. Housing assemblies 2 and 3 are coupled together in a fluid-tight manner by means of a plurality of bolts 6 and sealing means 7, such as an O-ring. The housing section 4 is coupled to the housing section 5 of the housing assembly 2 by means of an annular clamp (not shown) which fits over corresponding annular trapezoidal extensions 13, 14.

In the interior of the housing assembly 2, specifically the housing section 4, there is provided a centrifugal blade 10 having a plurality of curved surfaces 11, 12, and other surfaces not shown. The housing section 4 has an opening or air inlet designated generally as 15 formed by forwardly directed wall surfaces 16 of the housing section 4.

The blade 10 is mounted to the end of a shaft 20 by means of a nut 21 and washer 22. The wall 16 of the housing section 4 is curved as shown at 23 to conform to the curve of the centrifugal blade 10.

Below the blade 10 there is provided in the housing section 4 an air outlet designated generally as 25. An air passageway 26 couples the outlet 25 to the centrifugal blade 10. The size of the outlet 25 and the engine components coupled thereto are chosen to provide the required boost.

The blade 10 is supported on the end of the shaft 20 in a cantilever fashion by means of a roller bearing 30. The bearing 30 is mounted in the housing section 5 of the housing assembly 2. For convenience, the housing assembly 2 is also called the blower housing.

Mounted to the opposite end of the shaft 20 there is provided a rotor 40 of a brushless d-c electric motor designated generally as 41 by means of a nut 42 and a washer 43. An electric motor stator 44 is mounted to an interior surface of the housing section 8 of the housing assembly 3.

The rotor 40 of the electric motor 41 is supported on the opposite end of the shaft 20 in a cantilever fashion by means of a roller bearing 45. Extending from the exterior of the housing section 8 of the housing assembly 3 there is provided a plurality of cooling fins 46.

When joined together, the housing section 5 of the housing assembly 2 and the housing section 9 of the housing assembly 3 form a space or means 50 therebetween for containing a lubricating fluid 51 such as, for example, transmission fluid.

Mounted to the shaft 20 between the bearings 30 and 45 there is provided a flat disk-shaped member 52, also called a lubrication slinger. The lubrication slinger 52 is provided for slinging oil into the space 50 creating an oil mist which permeates the bearings 30 and 45 for lubricating the bearings.

Located between the centrifugal blade 10 and the bearing 30 there is provided a seal 60 and washer 61. Located between the bearing 45 and the rotor 40 there is provided a seal 62 and a washer 63. The seal and washer 60, 61 and the seal and washer 62, 63 serve to contain the fluid in the space 50 in the lubricating fluid containing means and thereby prevent its flow through the bearings 30 and 45.

In a typical embodiment of the supercharger 1, the motor 41 is adapted to provide in response to an applied voltage of from 50 to 100 volts approximately 10 hp at approximately 60,000 rpm.

Figure 2:
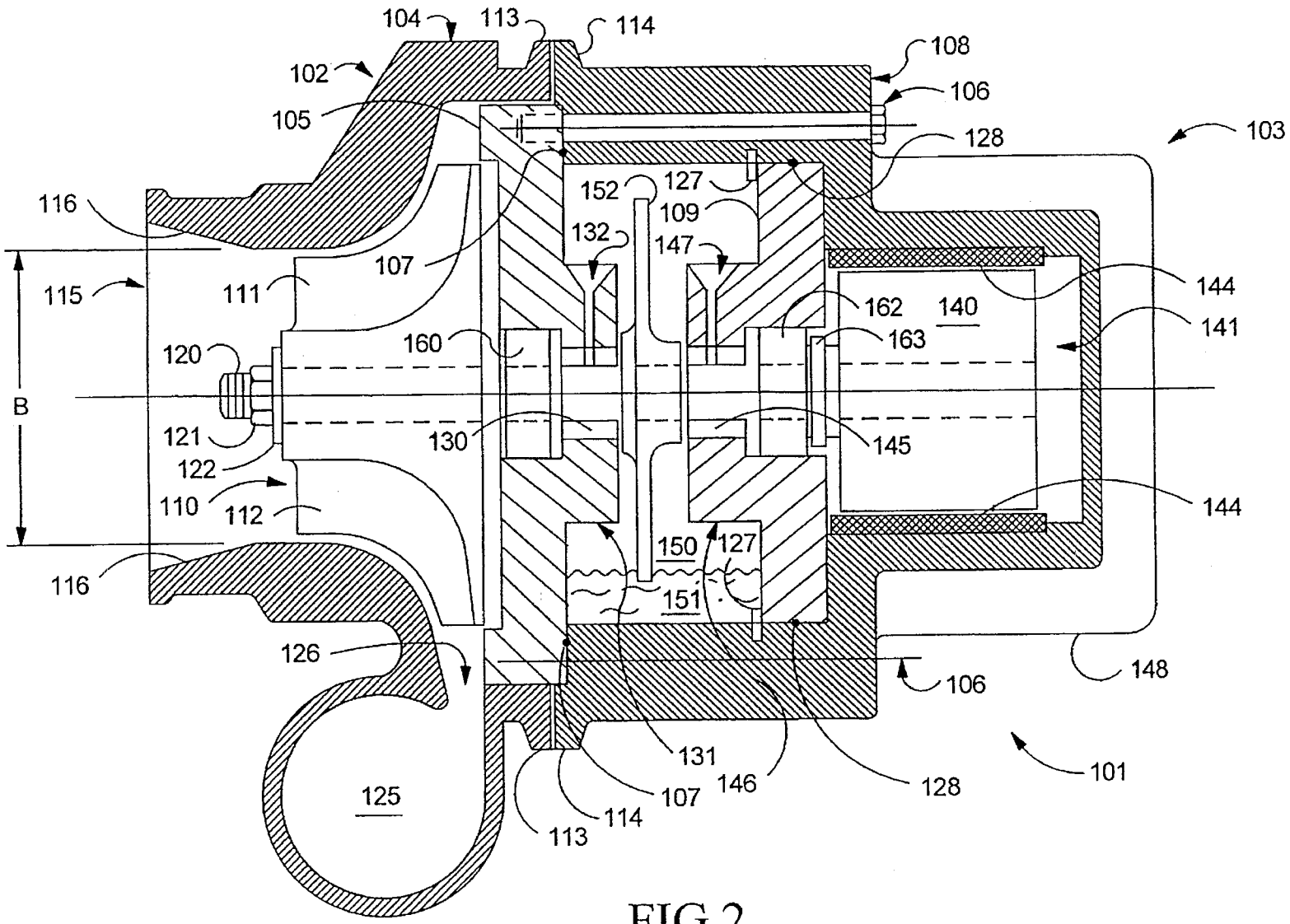
FIG. 2 is a cross-sectional view taken along a plane through the center of an electric supercharger according to another embodiment of the present invention.

Referring to FIG. 2, there is provided another embodiment of an electrical supercharger according to the present invention designated generally as 101. In the supercharger 101 there is provided a first housing assembly designated generally as 102 and a second housing assembly designated generally as 103. The housing assembly 102, which may be called a blower housing, comprises a first housing section 104 and a second housing section 105 interior thereof. The housing assembly 103, which may be called a motor and lubrication housing, comprises a first housing section 108 and a second housing section 109 interior thereof. Housing sections 105 and 108 are coupled together in a fluid-tight manner by means of a plurality of bolts 106 and sealing means 107, such as an O-ring. In the interior of housing section 108 there is provided an annular snap ring 127 against which the housing section 109 abuts when the housing section 108 is bolted to section 105 by the bolts 106. A sealing means 128, such as an O-ring, provides a fluid-tight seal between the sections 108 and 109. The housing section 104 of the housing assembly 102 is coupled to the housing section 108 of the housing assembly 103 by means of an annular clamp (not shown) which fits over corresponding annular trapezoidal extensions 113, 114.

In the interior of the housing assembly 102, specifically the housing section 104, there is provided a centrifugal blade 110 having a plurality of curved surfaces 111, 112, and other surfaces not shown. The housing section 104 has an opening or air inlet designated generally as 115 formed by forwardly directed wall surfaces 116 of the housing section 104.

The blade 110 is mounted to the end of a shaft 120 by means of a nut 121 and washer 122. The wall 116 of the housing section 104 is curved as shown at 123 to conform to the curve of the centrifugal blade 110.

Below the blade 110 there is provided in the housing section 104 an air outlet designated generally as 125. An air passageway 126 couples the outlet 125 to the centrifugal blade 110. The size of the outlet 125 and the engine components coupled thereto are chosen to provide the required boost.

The blade 110 is supported on the end of the shaft 120 in a cantilever fashion by means of a cylindrical sleeve bearing 130. The bearing 130 is mounted in an extended section 131 of the housing section 105 of the housing assembly 102. Extending downwardly through an upper portion of the section 131 there is a funnel-shaped passageway 132 through which a lubricating fluid passes to lubricate the bearing 130.

Mounted to the opposite end of the shaft 120 there is provided a rotor 140 of a brushless d-c electric motor designated generally as 141. An electric motor stator 144 is mounted to an interior surface of the housing section 108 of the housing assembly 103.

The rotor 140 of the electric motor 141 is supported on the opposite end of the shaft 120 in a cantilever fashion by means of a cylindrical sleeve bearing 145. The bearing 145 is mounted in an extended section 146 of the housing section 109. Extending downwardly through an upper portion of the section 146 there is a funnel-shaped passageway 147 through which a lubricating fluid passes to lubricate the bearing 145. Extending from the exterior of the housing section 108 of the housing assembly 103 there is provided a plurality of cooling fins 148.

When joined together, the housing section 105 of the housing assembly 102 and the housing section 109 of the housing assembly 103 form a space or means 150 therebetween for containing a lubricating fluid 151 such as, for example, transmission fluid.

Mounted to the shaft 120 between the bearings 130 and 145 there is provided a flat disk-shaped member 152, also called a lubrication slinger. The lubrication slinger 152 is provided for slinging oil into the space 150 creating an oil mist which passes through the passageways 132 and 147 and permeates the bearings 130 and 145 for lubricating the bearings.

Located between the centrifugal blade 110 and the bearing 130 there is provided a seal 160. Located between the bearing 145 and the rotor 140 there is provided a seal 162 and a washer 163. The seal 160 and the seal and washer 162, 163 serve to contain the fluid in the space 150 in the lubricating fluid containing means and thereby prevent its flow through the bearings 130 and 145.

In a typical embodiment of the supercharger 101, the motor 141 is adapted to provide in response to an applied voltage of from 50 to 100 volts approximately 10 hp at approximately 60,000 rpm.

While preferred embodiments of the present invention are described above, it is contemplated that numerous modifications may be made thereto for particular applications without departing from the spirit and scope of the present invention. For example, while bearings 30 and 45 are described as being roller bearings, they may also comprise sleeve bearings or other types of high speed bearings suitable for supporting shafts which are being driven at high rates of rotation, e.g. 50,000 rpm–60,000 rpm. Also, it will be appreciated that while a particular type of brushless d-c direct drive motor is described above, motors having different power ratings which operate at different rpm's and are responsive to different applied voltages may also be used in particular applications.

Accordingly, it is intended that the embodiments described be considered only as illustrative of the present invention and that the scope thereof should not be limited thereto but be determined by reference to the claims hereinafter provided.

In further summary therefore, an electric supercharger is described herein comprising a centrifugal blower for compressing air. The blower is mounted on one end of a shaft. A first bearing is provided for supporting the blower on said one end of the shaft in a cantilever fashion. The rotor of an electric motor is mounted on the opposite end of the shaft. A second bearing is provided for supporting the rotor on the opposite end of the shaft in a cantilever fashion. A lubricating fluid container is located between the first and the second bearings for containing a quantity of lubricating fluid. A slinger is also mounted on the shaft, which passes through the lubricating fluid container, for slinging the lubricating fluid and thereby conveying it to the first and second bearings. The motor, which is a brushless d-c motor, is designed to provide in response to a 50 to 100 volt applied potential, approximately 10 horse power at approximately 60,000 rpm's.

Thus, what is disclosed includes the following.

(1.) A first electric supercharger comprising:

(1.1) blower means for compressing air mounted on one end of a shaft means;

(1.2) first bearing means for supporting said blower means on said one end of said shaft means in a cantilever fashion;

(1.3) electric motor means including a rotor means mounted on the opposite end of said shaft means;

(1.4) second bearing means for supporting said rotor means on said opposite end of said shaft means in a cantilever fashion;

(1.5) means located between said first and said second bearing means for containing a quantity of lubricating fluid; and (1.6) means located within said lubricating fluid containing means for slinging said lubricating fluid against said first and said second bearing means.

(2.) For the first electric supercharger (1.) it has been further disclosed that said shaft means comprises a generally cylindrical shaft member having said blower means mounted on one end of said shaft member and said rotor means mounted on the opposite end of said shaft member so that said electric motor means provides a direct drive for said blower means.

(3.) For the first electric supercharger (1.) it has been further disclosed that the electric supercharger further comprises:

(3.1) means for providing a housing for said blower means, said housing comprising an air inlet and an air outlet.

(4.) For the first electric supercharger of above part (3.) it has been further disclosed that said blower means comprises centrifugal blower means having curved blade surfaces facing said air inlet, said air outlet comprises an air passageway for receiving air from said centrifugal blower means, and said housing comprises an interior surface which conforms generally to the shape of said curved blade surfaces.

(5.) For the first electric supercharger (1.) it has been further disclosed that the electric supercharger comprises:

(5.1) means for providing a housing for said electric motor means; and (5.2) electric motor stator means mounted within said housing means adjacent to said rotor means.

(6.) For the first electric supercharger of above part (5.) it has been further disclosed that said housing means comprises external cooling fins.

(7.) For the first electric supercharger (1.) it has been further disclosed that said electric motor means comprises brushless d-c electric motor means.

(8.) For the first electric supercharger of above part (5.) it has been further disclosed that said electric motor means provides in response to a predetermined applied voltage, approximately 10 horsepower at approximately 60,000 rpm; wherein (9.) said predetermined voltage is approximately 50 to 100 volts.

(10.) For the first electric supercharger of above part (1.) it has been further disclosed that said first and said second bearing means comprises roller bearing means.

(11.) For the first electric supercharger of above part (1.) it has been further disclosed that said first and said second bearing means can comprise sleeve bearing means.

(12.) For the first electric supercharger of above part (1.) it has been further disclosed that the electric supercharger can comprise:

(12.1) first means located between said first bearing means and said electric motor means for sealing and thereby restricting a flow of said lubricating fluid from said lubricating fluid containing means into said electric motor means; and (12.2) second means located between said second bearing means and said centrifugal blower means for sealing and thereby restricting a flow of said lubricating fluid from said lubricating fluid containing means into said centrifugal blower means.

(13.) For the first electric supercharger of above part (12.) it has been further disclosed that said first and second sealing means comprises means for sealing and thereby restricting a flow of said lubricating fluid from said lubricating fluid containing means when said first and said second shaft means is rotating at a speed exceeding 50,000 rpm.

(14.) For the first electric supercharger of above part (1.) it has been further disclosed that the lubricating fluid slinging means comprises a flat disk-shaped member mounted on said shaft means.

What is disclosed further includes the following.

(15.) A second electric supercharger comprising:

(15.1) centrifugal blower means for compressing air mounted on one end of a shaft means;

(15.2) means for providing a housing for said blower means, said housing comprising an air inlet and an air outlet, said centrifugal blower means comprising curved blade surfaces facing said air inlet, said air outlet comprising an air passageway for receiving air from said centrifugal blower means, and said housing comprising an interior surface which conforms generally to the shape of said curved blade surfaces;

(15.3) first bearing means for supporting said blower means on said one end of said shaft means in a cantilever fashion;

(15.4) electric motor means comprising rotor means and stator means;

(15.5) means for providing a housing for said electric motor means;

(15.6) second bearing means for supporting said rotor means on said opposite end of said shaft means in a cantilever fashion;

(15.7) means for mounting said stator means within said housing means adjacent to said rotor means;

(15.8) means located between said first and said second bearing means for containing a quantity of lubricating fluid; and (15.9) means located within said lubricating fluid containing means for slinging said lubricating fluid against said first and said second bearing means.

(16.) For the second electric supercharger of above part (15.) it has been further disclosed that said means for providing a housing for said blower means comprises a first housing means and said means for providing a housing for said electric motor means comprises a second housing means and further comprising means for coupling said first and said second housing means together in a fluid-tight manner so as to form said lubricating fluid containing means therebetween and further comprising:

(16.1) first means located between said first bearing means and said electric motor means for sealing and thereby restricting a flow of said lubricating fluid from said lubricating fluid containing means into said electric motor means; and (16.2) second means located between said second bearing means and said centrifugal blower means for sealing and thereby restricting a flow of said lubricating fluid from said lubricating fluid containing means into said centrifugal blower means.

What is claimed is:

1. A direct-drive electric supercharger for increasing air supply to cylinders of a corresponding internal combustion engine beyond that normally pumped in by pistons of the engine at a prevailing atmospheric pressure so as to boost power output by the engine, said supercharger comprising:

(a) a shaft having first and second ends;

(b) a centrifugal fan blade mounted on the shaft for supplying air to said cylinders;

(c) a brushless DC electric motor having a stator and a rotor, said rotor being mounted on the shaft, said brushless DC electric motor being for directly rotating the shaft and centrifugal fan blade at a speed sufficient to substantially boost the power output of the engine; and (d) a fan housing surrounding the centrifugal fan blade, said fan housing being adapted to couple the air supplied by the fan blade to the corresponding internal combustion engine.

2. A direct-drive electric supercharger according to claim 1 wherein said brushless DC electric motor operates at a rotational speed equal to or greater than approximately 50,000 RPM.

3. A direct-drive electric supercharger according to claim 2 wherein said brushless DC electric motor operates at a rotational speed of approximately 60,000 RPM.

4. A direct-drive electric supercharger according to claim 1 wherein said brushless DC electric motor outputs at least 10 horsepower.

5. A direct-drive electric supercharger according to claim 1 wherein said brushless DC electric motor operates from a power supply of between 50 to 100 volts.

6. A direct-drive electric supercharger according to claim 1 wherein said brushless DC electric motor reaches full boost speed within about 1second.

7. A direct-drive electric supercharger according to claim 1 further comprising:

(e) bearing means rotatably mounted about the shaft between the centrifugal fan blade and the rotor, for rotatably supporting the combination of the shaft, the centrifugal fan blade and the rotor.

8. A direct-drive electric supercharger according to claim 7 wherein said centrifugal fan blade and said rotor are cantilevered respectively at the first and second ends of the shaft.

9. A direct-drive electric supercharger for increasing air supply to cylinders of a corresponding internal combustion engine beyond that normally pumped in by pistons of the engine at a prevailing atmospheric pressure so as to boost power output by the engine, said supercharger comprising:

(a) a shaft having first and second ends;

(b) a centrifugal fan blade mounted on the shaft for supplying air to said cylinders; and (c) a brushless DC electric motor having a stator and a rotor, said rotor being mounted on the shaft, said brushless DC electric motor being for directly rotating the shaft and centrifugal fan blade at a speed sufficient to substantially boost the power output of the engine; and (d) bearing means rotatably mounted about the shaft between the centrifugal fan blade and the rotor, for rotatably supporting the combination of the shaft, the centrifugal fan blade and the rotor;

wherein the bearing means has first and second spaced apart bearings supporting the shaft, said supercharger further comprising:

(e) lubricating means interposed between the first and second bearings for applying a lubricating fluid to the first and second bearings.

10. A direct-drive electric supercharger according to claim 9 further comprising:

(f) a first stationary housing member to which the first bearing is attached;

(g) a second stationary housing member to which the second bearing is attached;

wherein the first and second stationary housing members mate to define therebetween a lubricant-containing cavity for containing said lubricating fluid.

11. A direct-drive electric supercharger according to claim 10 further comprising:

(h) a third stationary housing member to which the stator is attached;

wherein the second and third housing members mate to define a rotor-containing cavity for containing said motor rotor.

12. A direct-drive electric supercharger according to claim 11 wherein the stator is attached to an inner wall of said third stationary housing member, said inner wall defining a portion of the rotor-containing cavity.

13. A direct-drive electric supercharger according to claim 12 wherein third housing member has cooling fins extending from an exterior portion thereof.

14. A direct-drive electric supercharger according to claim 11 further comprising:

(i) a fourth housing member, wherein the fourth housing member mates with the first housing member to define a blade-containing cavity for containing said centrifugal fan blade and for directing airflow into and out of the blade-containing cavity.

* * * * *